US008867965B2

(12) United States Patent
Suto et al.

(10) Patent No.: US 8,867,965 B2
(45) Date of Patent: Oct. 21, 2014

(54) IMAGE FORMING APPARATUS WITH DEVICE FOR PREVENTING GEAR DISENGAGEMENT

(75) Inventors: Takuya Suto, Mishima (JP); Daisuke Aoki, Yokohama (JP); Nobukazu Adachi, Yokohama (JP); Kiyoharu Yoshioka, Yokohama (JP); Masao Amano, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 250 days.

(21) Appl. No.: 13/208,691

(22) Filed: Aug. 12, 2011

(65) Prior Publication Data

US 2012/0045248 A1 Feb. 23, 2012

(30) Foreign Application Priority Data

Aug. 17, 2010 (JP) ..... 2010-182229

(51) Int. Cl.
*G03G 15/01* (2006.01)
*G03G 15/00* (2006.01)

(52) U.S. Cl.
CPC ..... *G03G 15/757* (2013.01)
USPC ..... 399/227; 399/167

(58) Field of Classification Search
USPC ..... 399/167, 227
See application file for complete search history.

(56) References Cited

U.S. PATENT DOCUMENTS

| | | | | |
|---|---|---|---|---|
| 7,267,338 | B2 | 9/2007 | Kuwata et al. | |
| 7,448,619 | B2 | 11/2008 | Kuwata et al. | |
| 7,664,436 | B2 | 2/2010 | Aoki et al. | |
| 2008/0286010 | A1 | 11/2008 | Aoki et al. | |
| 2011/0013941 | A1* | 1/2011 | Aoki | 399/227 |

FOREIGN PATENT DOCUMENTS

| | | | |
|---|---|---|---|
| JP | 2005-148319 | A | 6/2005 |

* cited by examiner

*Primary Examiner* — David Gray
*Assistant Examiner* — Erika J Villaluna
(74) *Attorney, Agent, or Firm* — Fitzpatrick, Cella, Harper & Scinto

(57) ABSTRACT

An image forming apparatus includes an image bearing member for bearing an electrostatic image; a rotatable supporting member swingably supporting the rotatable supporting member, the rotatable supporting member being provided with a first gear portion and being rotatable while carrying a plurality of developing devices for developing the electrostatic image with toner; a drive transmission device for transmitting a rotational force to the rotatable supporting member, the drive transmission device being provided with a second gear portion engaged with first gear portion at an engagement position; and an opposing portion provided opposed to the rotatable supporting member with a gap therebetween which is smaller than an amount of engagement between the first gear portion and the second gear portion.

9 Claims, 7 Drawing Sheets

(a)

(b)

(a)

(b)

IMAGE FORMING APPARATUS WITH DEVICE FOR PREVENTING GEAR DISENGAGEMENT

FIELD OF THE INVENTION AND RELATED ART

The present invention relates to an image forming apparatus, such as an electrophotographic multicolor or full-color laser beam printer (capable of monochromatic images different in color or multicolor image), an electrophotographic copying machine, etc.

There have been known various electrophotographic color image forming apparatuses. One of them is a four cycle image forming apparatus, such as the one disclosed in Japanese Laid-open Patent Application 2005-148319. The image forming apparatus in this patent application has four developing devices, and a single development station shared by the four developing devices. More specifically, the four developing devices, which are different in the color of the developer therein, are supported by a rotary (developing device supporting rotational member), which is rotated by a driving force transmitting member, through which rotary driving force is transmitted from a motor to the rotary. Thus, as the rotary is rotated, the four developing devices, different in the developer color, are sequentially moved into the development station, that is, the station in which each developing device opposes the image bearing member, whereby the latent image on the image bearing member is developed by the opposing developing device. The rotary is supported by a rotary supporting member attached to the main assembly of the image forming apparatus in such a manner that it can be tilted relative to the main assembly. Thus, as the rotary supporting member is tilted, one of the developing devices is placed in contact with, or separated from, the image bearing member.

However, an image forming apparatus structured so that its driving force transmitting member and rotary are engaged with each other and are controlled in rotational phase suffers from the problem that as the main assembly of the image forming apparatus is subjected to a shock, the driving force transmitting member (driving force transmitting device) and rotary (developing device supporting rotational member) are likely to become temporarily disengaged from each other, and this temporary disengagement is likely to cause the driving force transmitting member and rotary to unsynchronize with each other in rotational phase.

SUMMARY OF THE INVENTION

The present invention was made in consideration of the above described problem. Thus, the primary object of the present invention is to provide an image forming apparatus, the driving force transmitting device and rotary (developing device supporting rotational member) of which do not disengage from each other even if the main assembly of the apparatus is subjected to a shock.

According to an aspect of the present invention, there is provided an image forming apparatus comprising an image bearing member for bearing an electrostatic image; a rotatable supporting member swingably supporting said rotatable supporting member, said rotatable supporting member being provided with a first gear portion and being rotatable while carrying a plurality of developing devices for developing the electrostatic image with toner; a drive transmission device for transmitting a rotational force to said rotatable supporting member, said drive transmission device being provided with a second gear portion engaged with first gear portion at an engagement position; and an opposing portion provided opposed to said rotatable supporting member with a gap therebetween which is smaller than an amount of engagement between said first gear portion and said second gear portion.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the present invention is described in detail with reference to the preferred embodiments of the present invention. The measurement, material, shape of each of the structural components of the image forming apparatus in the preferred embodiments of the present invention, and the positional relationship among the structural components, are not intended to limit the present invention is scope, unless specifically noted. That is, the present invention is also applicable to an image forming apparatus different in structure, operational mode, and the like, from those in the following preferred embodiments of the present invention.

Embodiment 1

Figure 1:
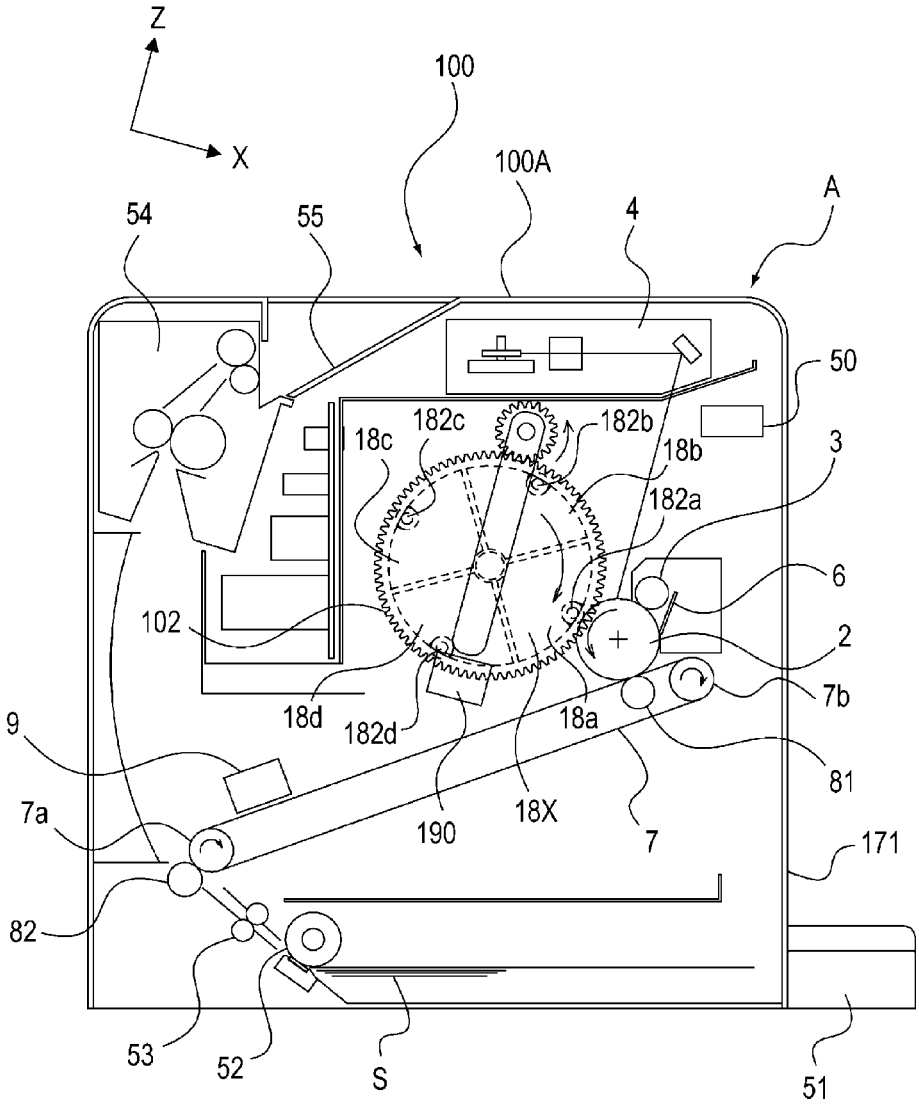
FIG. 1 is a schematic sectional view of the image forming apparatus in the first preferred embodiment of the present invention, and shows the general structure of the apparatus.

FIG. 1 is a schematic sectional view of the image forming apparatus 100 in the first preferred embodiment of the present invention, and shows the general structure of the apparatus. The image forming apparatus 100 is an electrophotographic image forming apparatus, which is assumed to be a color image forming apparatus, more specifically, a color laser beam printer having four developing devices. As is evident from FIG. 1, the image forming apparatus has a main assembly 100A (which hereafter may be referred to simply as "apparatus main assembly 100"). The image forming apparatus 100 has an image forming station for forming an image. The image forming station is in the apparatus main assembly 100A. It has an electrophotographic photosensitive drum 2 (where hereafter is referred to simply as "photosensitive drum 2") as an image bearing member, a primary transfer roller 81 as an image transferring device, etc.

The image forming apparatus 100 has the photosensitive drum 2. It has also a charge roller 3, an exposing device 4, four developing devices 18*a*-18*d*, a primary transfer roller 81, and a cleaning device 6, which are in the adjacencies of the peripheral surface of the photosensitive drum 2. The charge roller 3 (charging means) is a roller for uniformly charging the peripheral surface of the photosensitive drum 2. The exposing device 4 is a device for forming an electrostatic latent image (electrostatic image) on the uniformly charged portion of the peripheral surface of the photosensitive drum 2. More specifically, it forms an electrostatic image on the peripheral surface of the photosensitive drum 2 by scanning the uniformly charged portion of the peripheral surface of the photosensitive drum 2 with a beam of laser light it emits while modulating the beam of laser light with information of the image to be formed. Each of the developing devices 18*a*-18*d* is a device for developing an electrostatic latent image on the peripheral surface of the photosensitive drum 2 into a visible image by adhering developer to the electrostatic latent image on the photosensitive drum 2.

The developing device 18*a* contains yellow developer, and develops an electrostatic image with the yellow developer. The developing device 18*b* contains magenta developer, and develops an electrostatic latent image with the magenta toner. The developing device 18*c* contains cyan developer, and develops an electrostatic latent image with the cyan developer. The developing device 18*d* contains black developer, and develops an electrostatic latent image with the black developer. Further, the developing devices 18*a*-18*d* have development rollers 182*a*-182*d*, respectively.

An intermediary transfer belt 7 (intermediary transfer member) is suspended by the primary transfer roller 81, a roller 7*a*, and a roller 7*b*. The apparatus main assembly 100A is structured so that as the primary transfer roller 81, roller 7*a*, and roller 7*b* rotate, the intermediary transfer belt 7 circularly moves. The position of the photosensitive drum 2 corresponds to the position of the primary transfer roller 81. The cleaning device 6 (cleaning means) is a device for removing the developer remaining on the peripheral surface of the photosensitive drum 2 after the toner image transfer from the peripheral surface of the photosensitive drum 2.

A controller 50 controls the driving of various devices, such as the photosensitive drum 2, in the apparatus main assembly 100A. More concretely, as an image forming operation is started, the controller 50 rotates the photosensitive drum 2 in the direction (counterclockwise) indicated by an arrow mark, in such a manner that the rotation of the photosensitive drum 2 synchronizes with the circular movement of the intermediary transfer belt 7. As the photosensitive drum 2 is rotated in the counterclockwise direction, it causes the charge roller 3 to uniformly charge the peripheral surface of the photosensitive drum 2. Further, it causes the exposing device 4 to emit a beam of light in a manner to scan the charged portion of the peripheral surface of the photosensitive drum 2 while causing the exposing device 4 to modulate the beam of light with the information of the image to be forms. That is, the control 50 causes the exposing device 4 to form an electrostatic latent image, which corresponds to the yellow color component of the image to be formed.

The rotary 102 (developing device supporting rotational member) is a rotatable member structured so that it can rotate while holding the developing devices 18*a*-18*b* for developing an electrostatic latent image on the peripheral surface of the photosensitive drum 2. The rotary 102 is rotatably supported by the main assembly 100A. In synchronism of the formation of an electrostatic latent image on the peripheral surface of the photosensitive drum 2 by the exposing device 4, the rotary 102 is rotated by the rotary driving force transmitting mechanism so that the yellow developing device 18*a* is moved into the development position 18X, where the yellow developing device 18*a* opposes the photosensitive drum 2: the development roller 182*a* of the developing device 18*a* remains in contact with the peripheral surface of the photosensitive drum 2. Further, the controller 50 applies to the development roller 182*a*, such a voltage that is the same in polarity and is roughly the same in potential level as the electrical charge of the peripheral surface of the photosensitive drum 2, in order to cause the yellow developer to adhere to the peripheral surface of the photosensitive drum 2 in the pattern of the electrostatic latent image. Thus, the electrostatic latent image develops into a yellow toner image, that is, a visible image formed of yellow toner.

That is, as the rotary 102, which is holding the developing devices 18*a*-18*d*, is rotated as described above, the developing devices 18*a*-18*d* are sequentially moved into the development station 18X, where each developing device 18 opposes the photosensitive drum 2. In the developing station 18X, each of the developing devices 18*a*-18*d* develops an electrostatic latent image with the use of the developer it contains. Incidentally, the image forming apparatus 100 in this embodiment (first embodiment) is structured so that while an electrostatic latent image is developed by each of the developing devices 18*a*-18*d*, each of the development rollers 182*a*-182*d*, remains in contact with the photosensitive drum 2 (contact development). However, the application of the present invention is not limited to an image forming apparatus structured as the image forming apparatus in this embodiment. That is, the present invention is applicable to an image forming apparatus structured so that when each of the developing devices 18*a*-18*d* develops an electrostatic latent image on the peripheral surface of the photosensitive drum 2, each of the development rollers 182*a*-182*d* does not contact the peripheral surface of the photosensitive drum 2; it is positioned so that a preset minute amount of gap remains between the peripheral surface of a development roller 182 and the peripheral surface of the photosensitive drum 2. The effects of the application of the present invention to an image forming apparatus structured so that while an electrostatic latent image is developed, a preset minute amount of gap is kept between the peripheral surface of a development roller 182 and peripheral surface of the photosensitive drum 2 are the same as those obtained by the image forming apparatuses in the preferred embodiment, which are described later.

After the development of an electrostatic latent image on the peripheral surface of the photosensitive drum 2, a voltage which is opposite in polarity to the developer is applied to the primary transfer roller 81, which is on the inward side of the loop which the intermediary transfer belt 7 forms. As the voltage is applied, the yellow toner image on the photosensitive drum 2 transfers (first transfer) onto the intermediary transfer belt 7.

As for sheets S as recording media, multiple sheets S are stored in a cassette 51 which is in the bottom portion of the apparatus main assembly 100A. A sheet S is a medium onto which an image formed of developer is transferred from the intermediary transfer belt 7. For example, it is a sheet of recording paper, an OHP sheet, etc. Each sheet S of recording medium in the cassette 51 is fed into the apparatus main assembly 100A by a sheet conveyance roller 52 while being separated from the rest. Then, the sheet S of recording medium is conveyed to a pair of registration roller 53 (sheet conveyance rollers), which releases the sheet S with such a timing that the sheet S enters the interface between the intermediary transfer belt 7 and secondary transfer roller 82 at the same time as the layered four monochromatic images formed of the four developers, one for one, different in color. Incidentally, the secondary transfer roller 82 and intermediary transfer belt 7 are kept pressed upon each other (as shown in FIG. 1).

While the four monochromatic images, different in color, are layered on the intermediary transfer belt 7, the secondary transfer roller 82 is not in contact with the intermediary transfer belt 7, and neither is the cleaning unit 9 for removing the residual toner on the intermediary transfer belt 7.

As for a sheets S as recording medium, multiple sheets S are stored in a cassette 51 which is in the bottom portion of the apparatus main assembly 100A. A sheet S is a medium onto which an image formed of developer is transferred from the intermediary transfer belt 7. For example, it is a sheet of recording paper, an OHP sheet, etc. Each sheet S of recording medium in the cassette 51 is fed into the apparatus main assembly 100A by a sheet conveyance roller 52 while being separated from the rest. Then, the sheet S of recording medium is conveyed to a pair of registration roller 53 (sheet conveyance rollers), which releases the sheet S with such a timing that the sheet S enters the interface between the intermediary transfer belt 7 and secondary transfer roller 82 at the same time as the layered four monochromatic images formed of the four developers, one for one, different in color. Incidentally, the secondary transfer roller 82 and intermediary transfer belt 7 are kept pressed upon each other (as shown in FIG. 1).

The secondary transfer roller 82 is provided with a preset voltage which is opposite in polarity to the developers. Thus, as the sheet S is conveyed through the aforementioned interface between the intermediary transfer belt 7 and secondary transfer roller 82, the layered four monochromatic images formed of the four developers, one for one, different in color are transferred together onto the surface of the sheet S.

After the transfer of the images formed of the developers onto the sheet S, the sheet S is conveyed to a fixing device 54, through which it is conveyed. As the sheet S is conveyed through the fixing device 54, heat and pressure are applied to the sheet S and the four layered images thereon. As a result, the four images become fixed to the surface of the sheet S. As a result, a color image is effected on the sheet S. After being conveyed out of the fixing device 54, the sheet s is discharged into a delivery tray, which is a part of the top cover 55 of the apparatus main assembly 100A.

Figure 2:
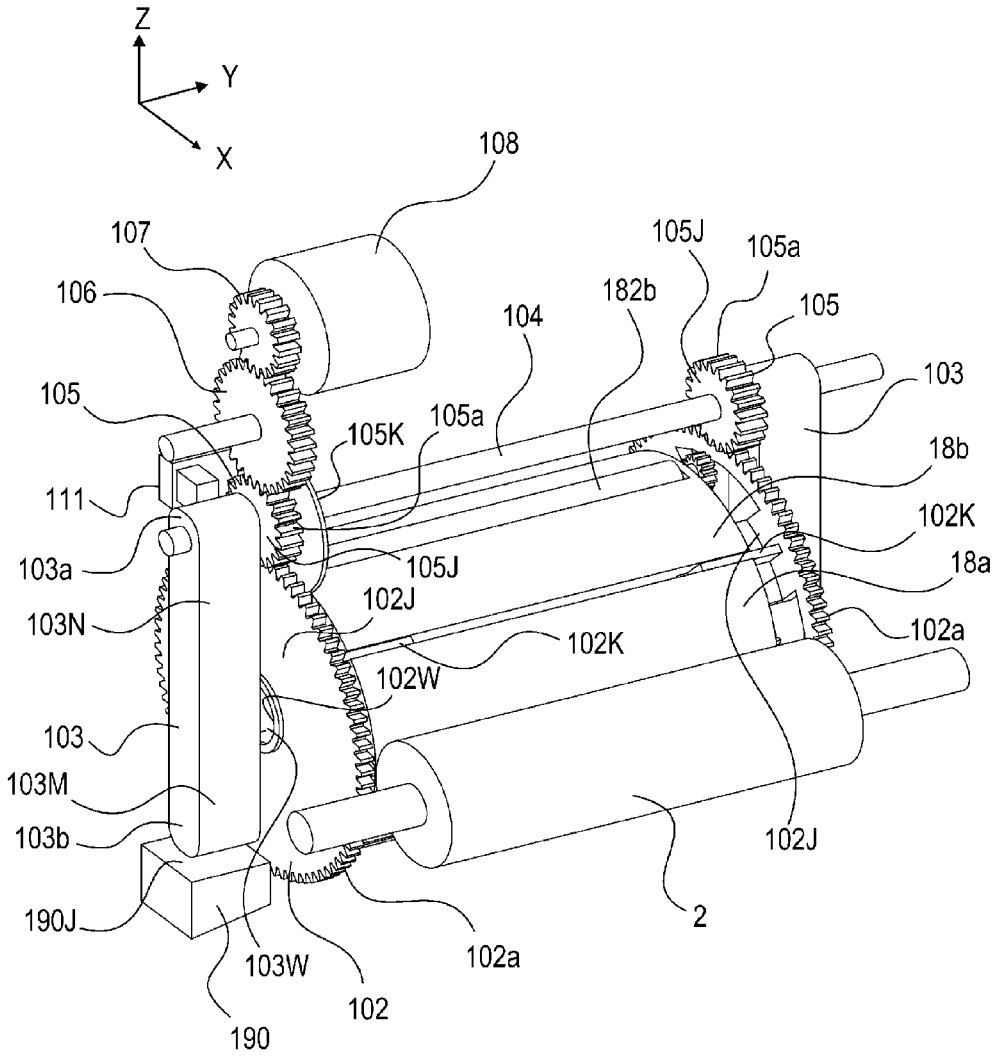
FIG. 2 is an enlarged perspective view of the rotary, and its adjacencies, of the image forming apparatus in this first preferred embodiment of the present invention, and shows their structure.
Figure 3:
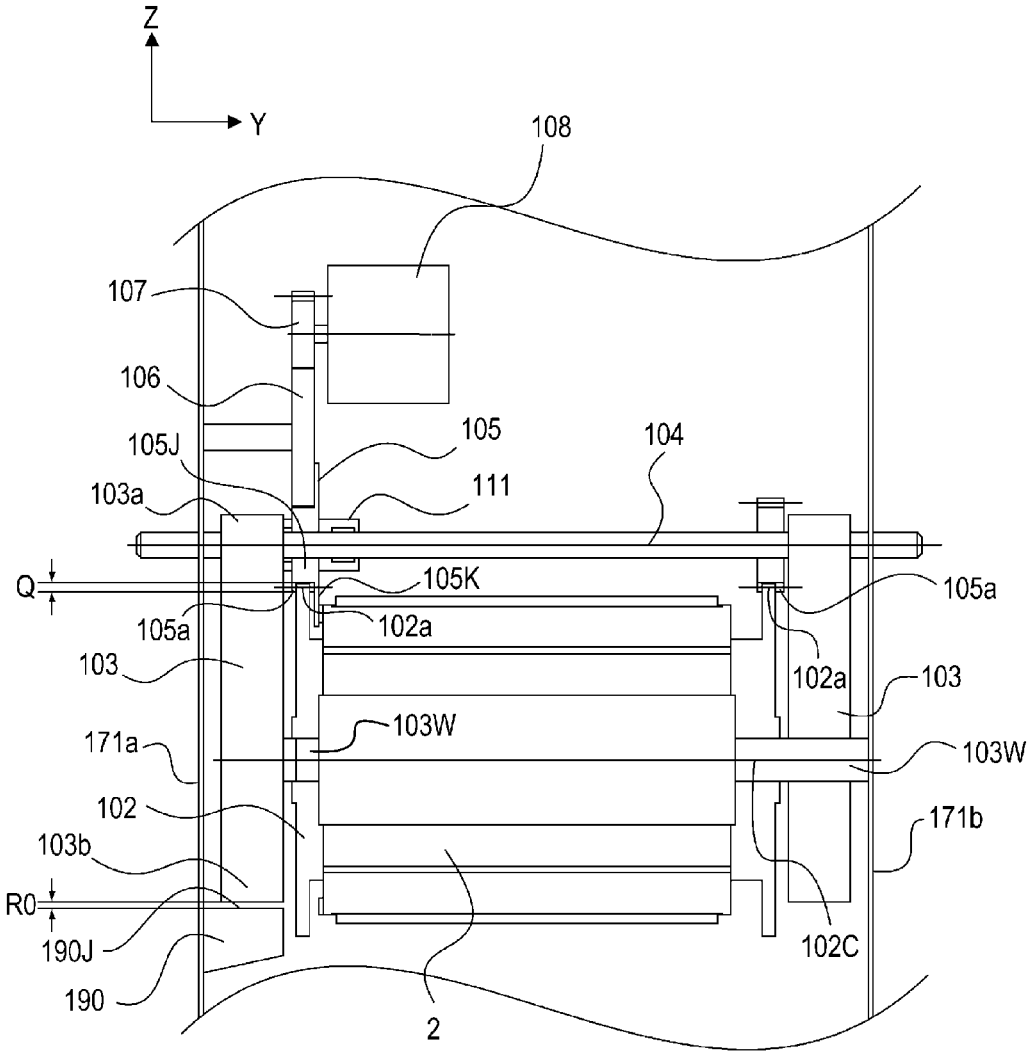
FIG. 3 is an enlarged side view of the rotary, and its adjacencies, of the image forming apparatus in the first preferred embodiment of the present invention, and shows their structure.

FIG. 2 is an enlarged perspective view of the rotary 102 and its adjacencies, and shows the structure of the rotary 102 and its adjacencies. However, FIG. 2 does not show the left and right lateral plates (walls) of the rotary 102, intermediary transfer belt 7, and primary transfer roller 81. In FIGS. 1, 2, and 3, a referential code Z stands for the direction which is parallel to the left lateral plate 171*a* (FIG. 3), and perpendicular to the rotational axle of the driving force transmission gear 105, and the bosses 103W, about which the rotary 102 rotates. A referential code X stands for the direction which is parallel to the left lateral plate 171*a* (FIG. 3) and perpendicular to the direction Z. Further, a referential code Y stands for the direction which is perpendicular to the left lateral plate 171*a* (FIG. 3) and perpendicular to both the directions Z and X.

Referring again to FIG. 2, the rotary 102 supports multiple developing devices 18 (four developing devices 18*a*-18*d*, in this embodiment). The developing devices 18*a*-18*d* are in the form of a cartridge which is removably mountable in the rotary 102 by a user. Thus, the developing devices 18*a*-18*d* in this embodiment are replaceable by a user, making it easier for a user to maintain the apparatus 100. Further, the rotary 102 has a pair of gears 102J as the first set of gears, and four partitions 102K. One of the pair of gears 102J is at one end of a hollow shaft 102W which extends from one end of the rotary 102 to the other in terms of the direction perpendicular to the axial line of the photosensitive drum 2, and the other gear 102J is at the other end of the shaft 102W. The four partitions 102K divide the space between the pair of gears 102J into four developing device chambers 102K in which the developing device 18*a*-18*d* are removably mountable, one for one. Each gear 102J has teeth 102*a*. Incidentally, the image forming apparatus 100 in this embodiment is structured so that its developing devices 18*a*-18*d* are removably mountable in the rotary 102. However, the application of the present invention is not limited to an image forming apparatus structured as the one in this embodiment. In other words, the present invention is also applicable to an image forming apparatus structured so that its developing devices 18 are solidly attached to its rotary.

The apparatus main assembly 100A has a drive shaft 104, as a rotational shaft, which is rotatably attached to the frame of the apparatus main assembly 100A. More specifically, the drive shaft 104 is rotatably supported by the left and right lateral plates 171*a* and 171*b* (FIG. 3) of the frame (outer shell) of the apparatus main assembly 100A.

Further, the apparatus main assembly 100A has a pair of arms 103 (angularly movable supporting member), as a pair of linkages, which are supported so that they can be angularly moved. More concretely, the base portion 103*a* of each arm 103 is fitted around the drive shaft 104 so that it is rotationally movable about the drive shaft 104. In other words, the arm 103 does not rotate with the drive shaft 104; the tip 103*b* of the arm 101, that is, the opposite end of arm 103 from the base portion 103*a*, is not supported at all. Further, each arm 103 is provided with a boss 103W, which is on the inwardly facing surface of the arm 103 and is between the base portion 103*a* and tip 103*b*. The boss 103W is fitted in the lengthwise hole of the shaft 102W of the rotary 102. Thus, the rotary 102 is rotatable about the boss 103W of the arm 103.

Figure 4:
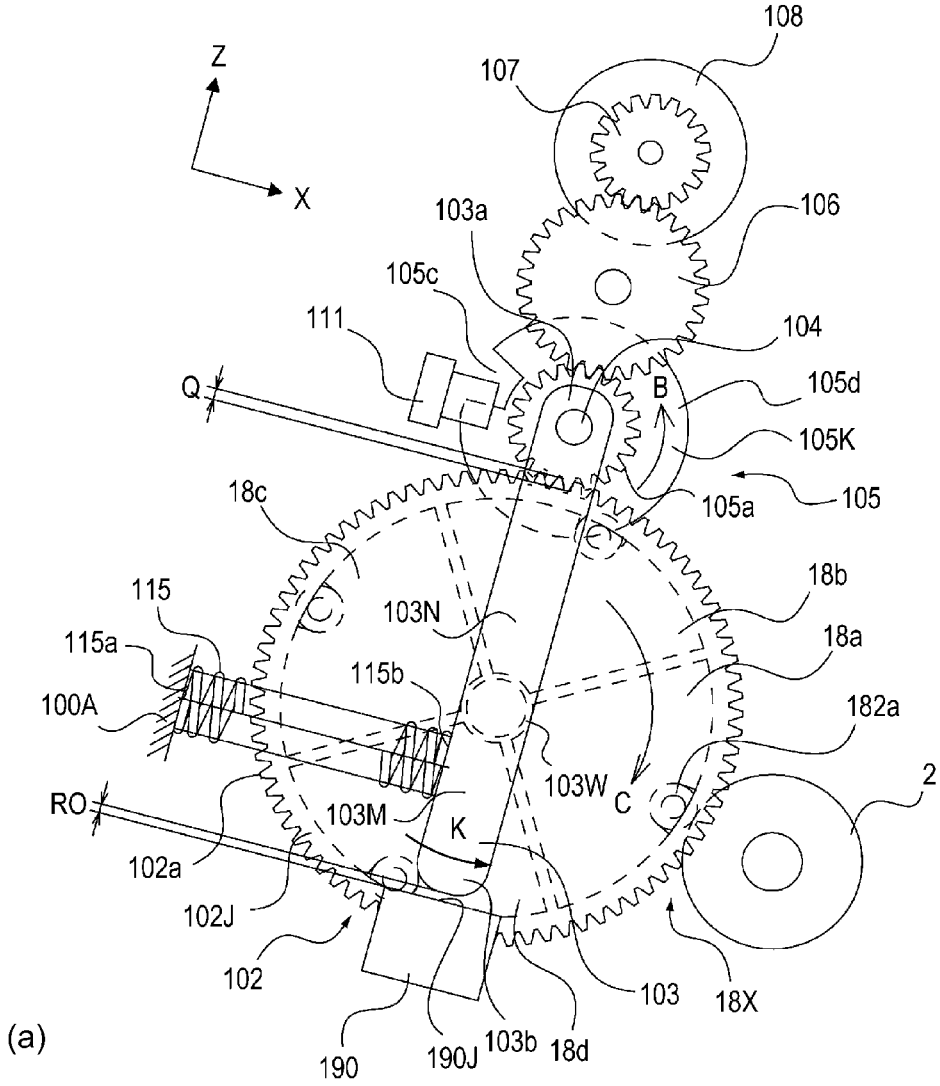
FIG. 4 is an enlarged front view of the rotary, and its adjacencies, of the image forming apparatus in this first preferred embodiment of the present invention, and shows their structure.
Figure 4:
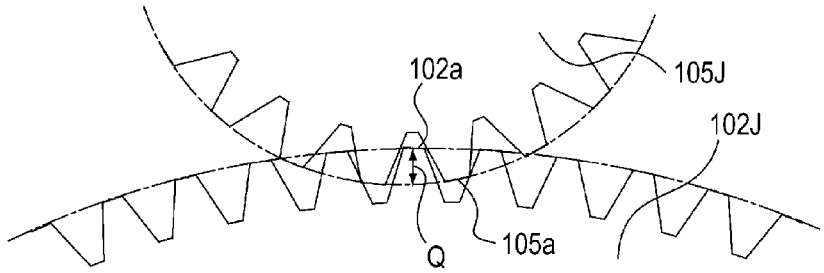

Designated by a referential code 103M is the portion of the arm 103, which is between the boss 103W of the arm 103 and the tip 103*b* of the arm 103. Hereafter, this portion will be referred to as a tip side portion 103M. Designated by a referential code 103N is the portion of the arm 103, which is between the boss 103W of the arm 103 and the tip 103*b* of the arm 103. Hereafter, this portion of the arm 103 will be referred to as a base side portion 103N. The tip side portion 103M of the arm 103 is kept pressed toward the photosensitive drum 2 by an arm spring 115 (elastic member) (FIG. 4). The arm spring 115 is a compression spring, for example. One end 115*a* of the spring 115 is attached to the apparatus main assembly 100A, and the other end 115*b* is attached to the tip side portion 103M of the arm 103 (FIG. 4). Thus, the arm 103 is kept pressed in the direction indicated by an arrow mark K by the resiliency of the arm spring 115. Therefore, one of the development rollers 182*a*-182*d* is kept pressed upon the photosensitive drum 2 (FIG. 4).

The drive shaft 104 is fitted with the pair of the driving force transmission gears 105 which are the parts of a driving force transmitting means (driving force transmitting device). More specifically, the gears 105 are solidly attached to the drive shaft 104. Therefore, the drive shaft 104 and gears 105 rotate together. One of the gears 105 is made up of a gear 105J (as second gear) and a disc 105K. The gear 105J and disk 105K are integral to each other, and therefore, rotate together. The other gear 105J is made up of a gear 105J alone. The rotary 102 is structured so that the teeth 105*a* (second teeth) of the gear 105J remain meshed (engaged) with the teeth 102*a* in a preset area. The disk 105K is solidly attached to the side wall (flat wall) of the gear 105J. Since the teeth 102*a* of the gear 102J of the rotary 102 are in mesh with the teeth 105*a* of the gear 105J of the driving force transmitting gear 105, the rotational force transmitted to the gear 105 is transmitted to the rotary 102. In this embodiment, the number of the teeth 102*a* of the rotary 102 is four times the number of teeth 105*a* of the driving force transmitting gear 105. Thus, as the driving force transmitting gear 105 rotates one full turn, the rotary 102 rotates one quarter of a full turn. In other words, as the driving force transmission gear 105 rotates four full turns, the rotary 102 rotates one full turn.

The driving force transmission gear 105 is in mesh with an idler gear 106, which is in mesh with a pinion gear 107 attached to the output shaft 108 of a pulse motor 108. Thus, the pulse motor 108 can rotate the rotary 102 by transmitting rotational force to the driving force transmission gear 105 by way of the pinion gear 107 and idler gear 106. In this embodiment, the pulse motor 108 is used as the power source for driving the rotary 102. However, the same effects as those obtained by the pulse motor 108 can be obtained with the employment of a combination of a DC motor equipped with a pulse encoder controllable in rotational phase, and an electromagnetic clutch capable of interrupting the transmission of driving force from the DC motor to the rotary 102. Further, the "driving force transmitting means (driving force transmitting device)" is made up of the driving force transmission gear 105, and idler gear 106, pinion gear 107. However, it may be replaced with a combination of gears and a toothed belt.

The apparatus main assembly 100A is provided with an arm catching member 190, which opposes one of the pair of arms 103. More specifically, the arm catching member 190 is positioned so that it opposes the tip 103*b* of one of the pair of arms 103. It has a surface 190J which directly faces the tip 103*b* of the arm 103.

FIG. 3 is an enlarged side view of the rotary 102 and its adjacencies, and shows their structure. FIG. 3, however, does not show the intermediary transfer belt 7 and primary transfer roller 81. The main assembly frame 171 (FIG. 1) is one of the structural members of the apparatus main assembly 100A. It has the left and right lateral plates 171*a* and 171*b*, which are solidly attached to an unshown stay or the like so that a preset distance is maintained between the left and right lateral plates 171*a* and 171*b*. The arm catching member 190 is attached to the left lateral plate 171*a*.

It is assumed here that the apparatus main assembly 100A image forming apparatus 100 falls to the floor while remaining in the state shown in FIG. 3. As the apparatus 100 falls, the apparatus main assembly 100A is subjected to a large amount of shock as the apparatus main assembly 100A hits the floor. In such a case, the weight of the rotary 102 and the weight of the developing devices 18*a*-18*d* supported by the rotary 102 are borne by the arms 103. Thus, the arms 103 are elastically deformed in the direction of gravity by the shock, allowing thereby the teeth 102*a* of the gear 102J of the rotary 102 to disengage from the teeth 105*a* of the driving force transmission gear 105. If the teeth 102*a* of the gear 102J of the rotary 102 disengage from the teeth 105*a* of the driving force transmission gear 105, that is, if the gear 102J and driving force transmission gear 105 become separated from each other, and one or both of the two gears 102J and 105 are subjected to a force, the direction of which is not parallel to the line which connects the center of the drive shaft 104 and the center of the rotary 102 in terms of the direction parallel to the axial line of the drive shaft 104, the rotary and/or driving force transmission gear 105 are rotated by this force. If the amount (angle) of the rotation of the rotary 102 and/or driving force transmission gear 105 exceeds the pitch of their teeth, the portion of the gear 102J, which was in engagement with a given portion of the driving force transmission gear 105, does not engage with the given portion of the driving force transmission gear 105 as the arms 103 straighten. That is, the gear 102J and driving force transmission gear 105 become unsynchronized in rotational phase.

FIG. 4(*a*) is an enlarged front view of the rotary 102 and its adjacencies when the rotary 102 is in the state in which the developing device 18*a* is in the development station 18X, and therefore, the development roller 182*a* of the yellow developing device 18*a* is opposing the photosensitive drum 2. It shows the structure of the rotary 102 and its adjacencies. In this embodiment, in order to prevent the problem that the rotary 102 and driving force transmission gear 105 become unsynchronized in rotational phase because of the above described accidental disengagement between the teeth 102*a* of the gear 102J of the rotary 102, and the teeth 105*a* of the driving force transmission gear 105, the gap between the arm 103 and arm catching member 190 is preset.

That is, the image forming apparatus 100 is structured so that an amount Q of engagement between the rotary 102 (one of teeth of gear 102J) and driving force transmission gear 105 (one of teeth of gear 105) in terms of the direction Z, and an amount R0 of the gap between the tip 103*b* of the arm 103 and the surface 109J of the arm catching member 190, which opposes the tip 103*b* of the arm 103 in terms of the direction Z satisfy the following inequality:

$$R0<Q \quad (1)$$

That is, the apparatus main assembly 100A is structured so that the amount R0 of the gap between the tip 103*b* of the arm 103 and the surface 109J of the arm catching member 109 is smaller than the amount Q of engagement between the two gears in terms of the direction Z. Therefore, as the apparatus main assembly 100A is subjected to a shock, the arm 103 comes into contact with the arm catching member 190, that is, the arm 103 is caught by the arm catching member 190, being thereby controlled by the arm catching member 190, before the teeth 102*a* of the rotary 102 become disengaged from the teeth 105*a* of the driving force transmission gear 105. Therefore, it does not occur that as the apparatus main assembly 100A is subjected to a shock, the teeth 102*a* of the rotary 102 separate from the teeth 105*a* of the driving force transmission gear 105. In other words, it is ensured that even if the apparatus main assembly 100A is subjected to a shock, the teeth 102*a* of the rotary 102 remain engaged with the teeth 105*a* of the driving force transmission gear 105. Therefore, it is ensured that even if the apparatus main assembly 100A is subjected to a shock, the rotary 102 and driving force transmission gear 105 do not become unsynchronized with each other in terms of rotational phase.

Further, the disc 105K of the driving force transmission gear 105, which rotates with the drive shaft 104, has a light blocking portion 105*d* and a light transmitting portion 105*c*. More concretely, the light transmitting portion 105*c* is a slit cut from the periphery of the disc 105K toward the center of the disc 105K, and the light blocking portion 105*d* is the rest of the disc 105K. Further, the apparatus main assembly 100A is provided with a phase sensor 111, which is an optical sensor. The phase sensor 111 has an unshown light emitting portion and an unshown light sensing portion, which are on the front and rear sides of the disk 105K, respectively. Thus, as the beam of light is emitted by the light emitting portion of the phase sensor 111 toward the light sensing portion of the phase sensor 111, the beam is blocked by the light blocking portion 105*d* of the disc 105K or is allowed to reach the light sensing portion of the phase sensor 111 through the slit 105*c* of the disk 105K, depending on the rotational phase of the disk 105K.

The teeth 102*a* of the rotary 102 and the teeth 105*a* of the driving force transmission gear 105 are meshed in such a manner that the point in time at which the beam of light emitted by the light emitting portion of the phase sensor 111 reaches the light sensing portion of the phase sensor 111 through the slit 105*c* of the disk 105K of the driving force transmission gear 105 coincides with the point in time at which the development roller 182*a*, for example, comes into contact with the photosensitive drum 2. As described previously, the number of the teeth 102*a* of the rotary 102 is four times the number of the teeth 105*a* of the driving force transmission gear 105. Therefore, the point in time at which each of the development rollers 182*a*-182*d* comes into contact with the photosensitive drum 2 coincides with the point in time at which the beam of light emitted by the light emitting portion of the phase sensor 111 reaches the light sensing portion of the phase sensor 111 through the slit 105*c*. That is, the apparatus main assembly 100A can recognize that the moment when the beam of light emitted by the light emitting portion of the phase sensor 11 has reached the light sensing portion of the phase sensor 111, one of the development rollers 182*a*-182*d* has just come into contact with the photosensitive drum 2. In other words, the phase sensor 111 makes it possible for the control 50 to precisely detect the rotational phase of the rotary 102 for every ¼ turn of the rotary 102.

As for the dimension of the arm catching member 190 in terms of the direction X, it is greater than the dimension of the arm 103 in terms of the direction X. Further, the dimension of the arm catching member 190 in terms of the direction Y is greater than the dimension of the arm 103 in terms of the direction Y. Therefore, it is ensured that regardless of the direction of the displacement of the arm 103, the arm 103 is caught by the arm catching member 190 before the teeth 102*a* of the gear 102J of the rotary 102 are disengaged from the teeth 105*a* of the driving force transmission gear 105.

In this embodiment, the apparatus main assembly 100A is provided with the arm catching member 190, which is dedicated to the prevention of the disengagement between the teeth 102*a* of the rotary 102 and the teeth 105*a* of the driving force transmission gear 105. However, instead of the provision of the arm catching member 190, the part of the left lateral plate 171*a*, which corresponds in position to the tip 103*b* of the arm 103, may be bent inward by 90° by cutting a pair of slits along the part. The effects of this structural arrangement are the same as those obtainable by the provision of the arm catching member 190 in this embodiment.

FIG. 4(*b*) is an enlarged schematic view of the area of engagement between the teeth 105*a* of the driving force transmission gear 105 and the teeth 102*a* of the rotary 102. It shows the state of the engagement (meshing). As will be evident from FIG. 4(*b*), the amount Q of engagement between the teeth 105*a* of the gear 105J and the teeth 102*a* of the gear 102J is the amount of the distance between the tip of the tooth 105*a* of the gear 105J and the tip of the corresponding tooth 102*a* of the gear 102J in terms of the direction parallel to the line which connects the centers of the gear 105J and gear 102J. Although drawings other than FIG. 4(*b*) do not show the state of engagement between the teeth 102*a* and teeth 105*a* as precisely as FIG. 4(*b*), the actual state of engagement between the teeth 102*a* and teeth 105*a* is as shown in FIG. 4(*b*).

Embodiment 2

Figure 5:
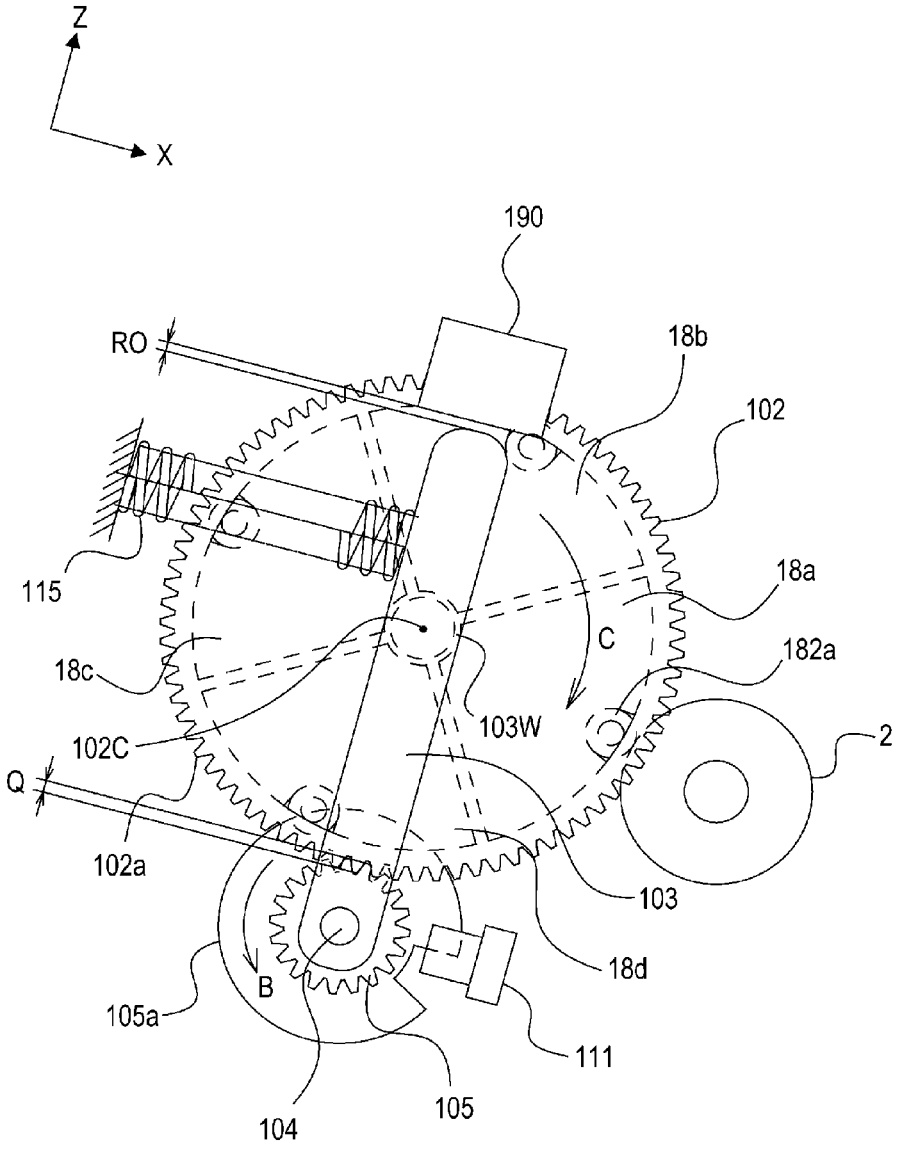
FIG. 5 is a schematic front view of the rotary, and its adjacencies, of the image forming apparatus in the second preferred embodiment of the present invention, and shows their structure.

FIG. 5 is a schematic front view of the rotary 102 and its adjacencies of the image forming apparatus in the second preferred embodiment of the present invention, and shows the structure of the rotary 102 and its adjacencies. The structural components of the rotary 102 and the structural components in the adjacencies of the rotary 102 in this embodiment, which are the same in structure and effect as the counterparts in the first embodiment, are given the same referential codes as those given to the counterparts, and are not going to be described here. The general structure of the image forming apparatus 100 in this embodiment is the same as that of the image forming apparatus 100 in the first embodiment, and therefore, is not described here. The difference between this embodiment and the first embodiment is only in the structure of the components in the adjacencies of the rotary 102. The difference is as follows: that is, in this embodiment, the driving force transmission gear 105 is on the underside of the rotational axis 102C (which coincides with axial line of cylindrical hollow of central shaft 102W of rotary 102). Further, the arm catching member 190 is on the topside of the rotational axis 102C (axial line of cylindrical hollow of central shaft 102W) of the rotary 102.

Referring to FIG. 5, in this embodiment, the arm catching member 190 is on the positive side of the axis Z, whereas the driving force transmission gear 105 is on the negative side of the axis Z. If it is desired to structure the image forming apparatus 100 so that a user can remove the developing devices 18*a*-18*d* from the apparatus main assembly 100A, from the top side of the rotary 102, a space for the guide for a user to access the developing devices 18*a*-18*d* has to be provided above the rotary 102. Thus, the driving force transmission gear 105, drive shaft 104, etc., are positioned under the rotary 102. With the positioning the driving force transmission gear 105, drive shaft 104, etc., under the rotary 102, the components which prevent a user from accessing the developing devices 18*a*-18*d* are not on the top side of the rotary 102, and therefore, the guides for a user to access the developing devices 18*a*-18*d* can be placed on the top side of the rotary 102.

Embodiment 3

Figure 6:
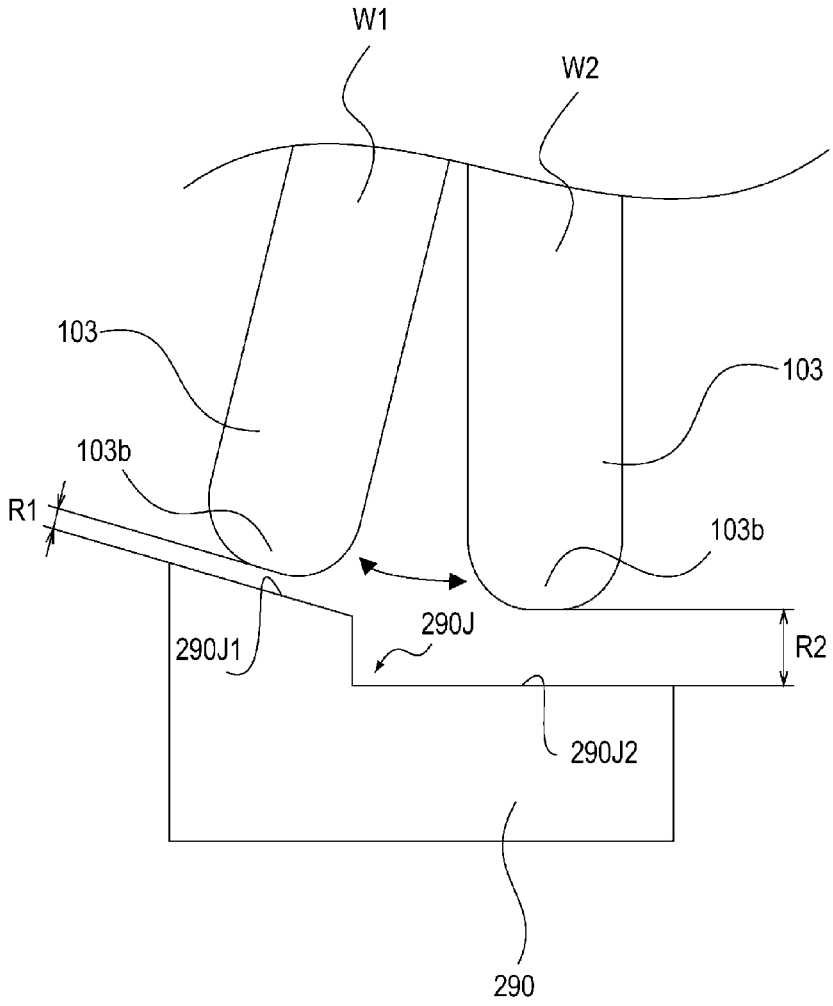
FIG. 6 is an enlarged front view of the arms and arm movement blocking member of the image forming apparatus in the third preferred embodiment of the present invention, and shows their structure.

FIG. 6 is an enlarged schematic front view of the area of engagement between the arm 103 and arm catching member 290 of the image forming apparatus in the third preferred embodiment of the present invention, and shows the structure of the arm 103 and arm catching member 290. The structural components of the rotary 102 and the structural components in the adjacencies of the rotary 102, which are the same in structure and effect as the counterparts in the first embodiment, are given the same referential codes as those given to the counterparts, and are not going to be described here. Further, the general structure of the image forming apparatus in this embodiment is the same as that of the image forming apparatus in the first embodiment, and therefore, is not described here. The difference between this embodiment and the first embodiment is only in the structure of the components in the adjacencies of the rotary 102. The difference is as follows: that is, in this embodiment, the distance (gap) between the arm catching member 290 and arm 103 is not uniform. In other words, the portion 290J of the arm catching member 290, which faces the arm 103, is not flat. That is, the portion 290J has a surface 290J1 and a surface 290J2 as shown in FIG. 6. Further, the distance R1 between the tip 103*b* of the arm 103 and the surface 290J1 of the portion 290J of the arm catching member 290 is different from the distance R2 between the tip 103*b* of the arm 103 and the surface 290J2 of the portion 290J of the arm catching member 290. Incidentally, as described in later embodiments, the portion of an arm catching member 390, which faces the arm 103, and the portion of an arm catching member 490, which faces the arm 103, may also be provided with multiple surfaces, which are different in the distance R from the tip 103*b* of the arm 103.

In the third embodiment, in order to prevent the developing device 18*a*, 18*b*, 18*c*, or 18*d* from colliding with the photosensitive drum 2 when the image forming apparatus 100 is being transported in a shipment package or the like, the apparatus main assembly 100A is provided with an unshown removable member for keeping the rotary 102 displaced in the direction to keep the developing device 18 (development roller 182) separated from the drum 2, and therefore, the arm 103 is kept in a transportation position W1 That is, when the image forming apparatus 100 is being transported, the arm 103 is kept in the transportation position W1.

Thus, when the image forming apparatus 100 in this embodiment is readied for image formation for the first time, the aforementioned removable member is removed to allow the development roller 182*a*, 182*b*, 182*c*, or 182*d* to be placed in contact with the photosensitive drum 2. As the removable member is removed, the arm 103 swings back to its normal position W2 (different from transportation position), moving thereby the rotary 102 supported by the arm 103 back into the operational position of the rotary. Thus, when the image forming apparatus 100 is in an image forming operation, the arm 103 is in the position W2, which is closer to the photosensitive drum 2 than the position W1. In other words, the image forming apparatus 100 is structured so that the arm 103 is movable between the normal position (closer to photosensitive drum 2) and the transportation position W1.

As for the gap to be provided between the arm catching member 290 and arm 103, if it is desired to make the gap uniform in terms of the direction in which the arm 103 swings, not only do the components involved in the gap have to be very precisely manufactured, but they also have to be very precisely assembled and attached relative to each other. As a solution to this issue, the arm catching member 290 in this embodiment is shaped so that the gap to be provided between the tip 103*b* of the arm 103 and the arm catching member 290 when the image forming apparatus 100 is being transported is different from that when the image forming apparatus 100 is in use. More specifically, the portion of the arm catching member 290, which faces the arm 103, is provided with the surfaces 290J1 and 290J2. The surface 290J1 provides the gap R1, which is for the transportation of the image forming apparatus 100, whereas the surface 290J2 provides the gap R2, which is for image formation. That is, the arm catching member 290 in this embodiment is provided with two surfaces 290J1 and 290J2, which correspond to the two positions of the arm 103, one for one.

There is the following relationship between the amount Q of engagement (in terms of direction of axis Z) between a tooth 102*a* of the rotary 102 and the corresponding tooth 105*a* of the driving force transmission gear 105 A, and the amount R1 (in terms of direction of axis Z) of the gap between the tip 103*b* of the arm 103 and the surface 290J1 of the arm catching member 290:

$$R1<Q \quad (2)$$

Further, there is the following relationship between the amount R2 (in terms of direction of axis Z) of the gap between the tip 103*b* of the arm 103 and the surface 290J2, and the amount R1 (in terms of direction of axis Z) of the gap between the tip 103*b* of the arm 103 and the surface 290J1 of the arm catching member 290, that is, the amount of the gap for transportation:

$$R2 \geq R1 \quad (3)$$

That is, the amount R2 of the gap for image formation is greater than the amount R1 of the gap for transportation. With this setup, the gap between the arm 103 and arm catching member 209 can be kept small while the apparatus 100 is transported, and then, it can be made normal for image formation when the apparatus 100 is used for the first time. In other words, this embodiment affords more latitude in terms of the design of the apparatus 100. The relationship between the amounts R2 and Q satisfies the following inequality, for the following reason. That is, the gear disengagement is one of the problems which occur during the transportation of the image forming apparatus. Therefore, the amount R2 of the gap between the tip 103*b* of the arm 103 and arm catching member 290 does not need to be made smaller than the amount Q of engagement between the two gears 102J and 105.

$$R2>Q \quad (4)$$

According to the structural arrangement for the main assembly of an image forming apparatus in each of the first to third preferred embodiments of the present invention, as the image forming apparatus 100 is subjected to a shock, the movement of the arm 103 is regulated by the arm catching member 190 or 290 before the teeth 102*a* of the rotary 102 are made to disengage from the teeth 105*a* of the driving force transmission gear 105 by the shock. Therefore, even if the image forming apparatus 100 is subjected to a shock, the teeth 102*a* of the rotary 102 are unlikely to disengage from teeth 105*a* of the driving force transmission gear 105.

Further, in description of the first to third preferred embodiments of the present invention, it was assumed that the arm catching members 190 and 290, and left lateral plate 171*a* were strong enough for their deformation attributable to the shock to be negligible. Further, even if the arm catching members 190 and 290, and left lateral plate 171*a* happen to be deformed, the force which was to be borne by the arm 103 is partially borne by the arm catching member 190 or 290, and left lateral wall 171*a*. In other words, the present invention reduces the amount by which the arm 103 is deformed by the shock to which the image forming apparatus is subjected.

Figure 7:
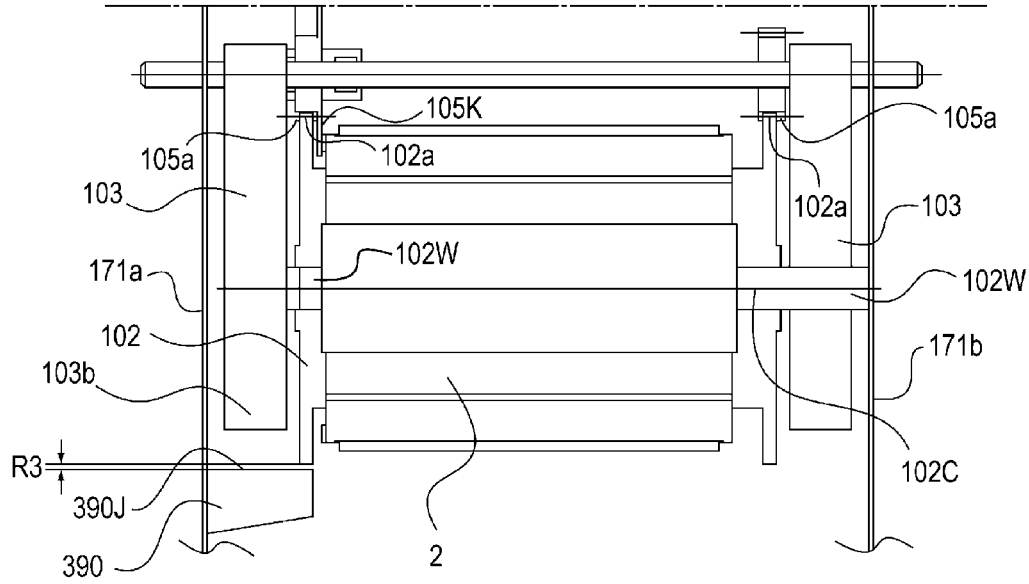
FIG. 7 is a schematic sectional view of the rotary and modified version of the arm movement blocking member in the preferred embodiments of the present invention, and shows their structure.
Figure 7:
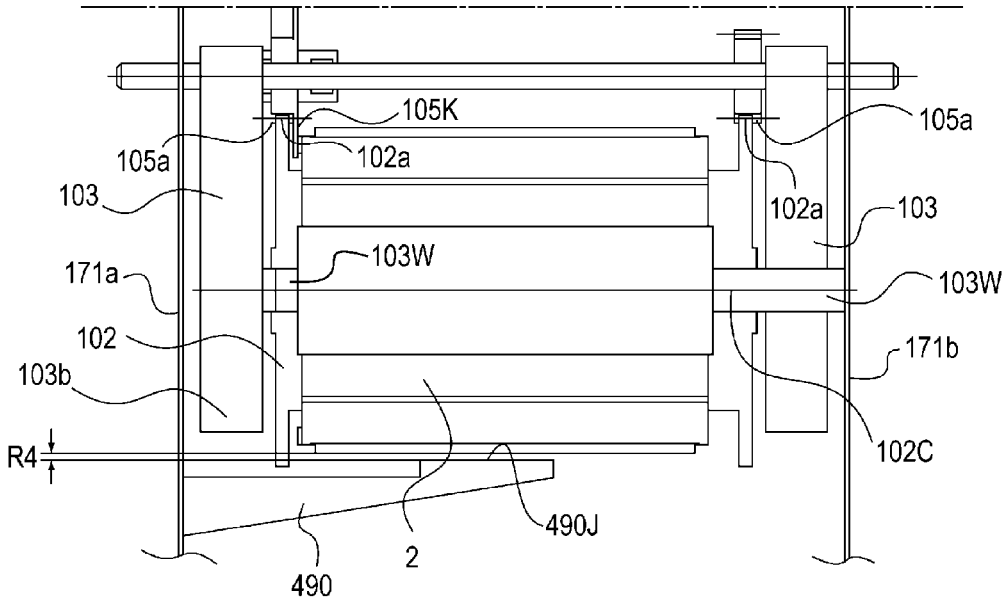

Further, in the first embodiment, the amount R0 of the gap between the tip 103*a* of the arm 103 and the surface 190J of the arm catching member 190 is preset. However, the present invention is also applicable to an image forming apparatus structured so that instead of a preset amount R0 of gap being provided between the tip 103*b* of the arm 103 and the arm catching member 190, a gap R3 is provided between the tip of a tooth 102*a* of the rotary 102 and the arm catching member 390 as an arm displacement controlling portion (FIG. 7(*a*)). The effects of this structural arrangement are the same as those in the first embodiment. Further, the present invention is also applicable to an image forming apparatus structured so that a gap R4 is provided between the peripheral surface of the development roller 182 (182*a*-182*d*) of the developing device 18 (18*a*-18*d*) and the surface 490J of the arm catching member 490 (FIG. 7(*b*)). The effects of this structural arrangement are the same as those obtained by the structural arrangement in the first embodiment. The following is the detail of this structural arrangement.

That is, the apparatus main assembly 100A is provided with the arm catching member 390, which is positioned on the opposite side of the rotary 102 (rotational axis 102C of rotary 102) from the area of engagement between the teeth 102*a* (first gear portion) of the rotary 102 and the teeth 105*a* (second gear portion) of the driving force transmission gear 105. Preferably, the arm catching member 390 is to be positioned so that the distance between the aforementioned area of engagement and the arm catching member 390 becomes the largest, and also, that the amount Q of engagement between a tooth 102*a* of the rotary 102 and the corresponding tooth 105*a* of the driving force transmission gear 105, and the amount R3 of the gap between the surface 390J of the arm catching member 390 and the tip 103*b* of the arm 103 satisfies the following inequality: Q>R3. With the employment of this structural arrangement, the displacement of the rotary 102 attributable to the shock to which the image forming apparatus 100 is subjected is interrupted by the arm catching member 390 before the teeth 102*a* of the rotary 102 become disengaged from the teeth 105*a* of the driving force transmission gear 105. Therefore, even if the image forming apparatus 100 is subjected to a shock, the teeth 102*a* of the rotary 102 do not become disengaged from the teeth 105*a* of the driving force transmission gear 105.

Further, the application of the present invention is not limited to an image forming apparatus structured as the one in the first embodiment. That is, the present invention is also applicable to an image forming apparatus structured so that not only is the arm catching member 490 on the directly opposite side of the rotary 102 from the area of engagement between the teeth 102*a* of the rotary 102 and the teeth 105*a* of the driving force transmission gear 105, with reference to the rotational axis 102C of the rotary 102, and the arm catching member 490 opposes one of the developing devices, preferably, the developing device 18 which is farthest from the area of the engagement, but also, the amount Q of engagement between the teeth 102*a* of the rotary 102 and the teeth 105*a* of the driving force transmission gear 105 is greater than the distance R4 between the surface 490J of the arm catching member 490 and the farthest of the multiple developing devices 18*a*-18*d* from the area of the engagement: Q>R4. With the employment of this structural arrangement, the displacement of one of the multiple developing devices 18*a*-18*d* attributable to the shock to which the image forming apparatus 100 is subjected is interrupted by the arm catching member 490 before the teeth 102*a* of the rotary 102 become disengaged from the teeth 105*a* of the driving force transmission gear 105. Therefore, even if the image forming apparatus 100 is subjected to a shock, the teeth 102*a* of the rotary 102 do not become disengaged from the teeth 105*a* of the driving force transmission gear 105.

Further, in the first to third preferred embodiments described above, the "first gear" was the gear 102J, and the "second gear" was the gear 105J. However, the present invention is also applicable to an image forming apparatus which has a driving force transmitting member such as a toothed belt in place of at least one of the "first and second" gears. In the case of an image forming apparatus which has a toothed belt or the like in place of at least one of the "first and second" gears, the "amount of engagement" is the amount of engagement between the teeth of one of the toothed belt and those of the other toothed belt, or between the teeth of the toothed belt and the teeth of the gear.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 182229/2010 filed Aug. 17, 2010, which is hereby incorporated by reference.

What is claimed is:

1. An image forming apparatus comprising:

an image bearing member for bearing an electrostatic image;

a rotary provided with a first gear portion and being rotatable while carrying a plurality of developing devices for developing the electrostatic image with toner;

a rotary supporting member swingably supporting said rotary;

a drive transmission device for transmitting a rotational force to said rotary, said drive transmission device being provided with a second gear portion engaged with said first gear portion at an engagement position; and an opposing portion opposed to said rotary supporting member with a gap therebetween, the gap being smaller than an amount of engagement between said first gear portion and said second gear portion, wherein said opposing portion does not contact said rotary supporting member in an image forming operation.

2. An apparatus according to claim 1, wherein said opposing portion is disposed at a position opposing a free end of said rotary supporting member, and the gap between said opposing portion and said rotary supporting member is defined as between said opposing portion and said free end portion and is smaller than the amount of engagement.

3. An apparatus according to claim 1, wherein said opposing portion is disposed at a position opposed to a first end of said rotary supporting member which is opposite a second end of said rotary supporting member that is adjacent to the engagement position.

4. An apparatus according to claim 3, wherein the position of said opposing portion is within a circumference of said gear portion.

5. An apparatus according to claim 3, wherein the position of said opposing portion is within an outer periphery of said developing devices supported by said rotary.

6. An apparatus according to claim 1, wherein the engagement position is below a center of rotation of said rotary supporting member, and said opposing portion is above the center of rotation.

7. An apparatus according to claim 1, wherein said rotary supporting member is movable between a close position for effecting development of the electrostatic image and a retracted position away from said image bearing member, and the gap in the retracted position is smaller than the amount of engagement between first gear portion and second gear portion.

8. An apparatus according to claim 1, wherein said opposing portion prevents disengagement between said rotary and said drive transmission device.

9. An apparatus according to claim 1, wherein upon impact, said opposing portion contacts said rotary supporting member.

* * * * *